US005262285A

United States Patent [19]

Darmon et al.

[11] Patent Number: 5,262,285

[45] Date of Patent: Nov. 16, 1993

[54] METHODS AND COMPOSITIONS FOR RETOUCHING FILM IMAGES

[75] Inventors: Charles M. Darmon, Spencerport; William G. Henry, Caledonia; Mary C. Kelley, Webster, all of N.Y.

[73] Assignee: Eastman Kodak Company, Rochester, N.Y.

[21] Appl. No.: 878,250

[22] Filed: May 4, 1992

[51] Int. Cl.[5] ..... G03C 11/04; G03C 7/18

[52] U.S. Cl. ..... 430/359; 430/431; 430/432; 430/461; 430/463; 430/462

[58] Field of Search ..... 430/431, 432, 461, 462, 430/359, 463

[56] References Cited

U.S. PATENT DOCUMENTS

| | | | |
|---|---|---|---|
| 2,100,594 | 11/1937 | Heymer | 430/462 |
| 2,564,238 | 8/1951 | Sprung | 430/462 |
| 3,620,744 | 11/1971 | Schellenberg et al. | 430/462 |
| 4,070,188 | 1/1978 | Nakamura et al. | 430/431 |
| 4,304,846 | 12/1981 | Marthaler et al. | 430/462 |
| 4,366,232 | 12/1982 | Buser et al. | 430/462 |
| 4,370,402 | 1/1983 | Anderson | 430/462 |
| 4,546,069 | 10/1985 | Libicky et al. | 430/462 |
| 4,868,098 | 9/1989 | Steiger et al. | 430/393 |
| 4,908,300 | 3/1990 | Koboshi et al. | 430/393 |
| 4,937,178 | 6/1990 | Koboshi et al. | 430/375 |

OTHER PUBLICATIONS

Defensive Publication, T896,053, published Mar. 28, 1972.

"The Theory of the Photographioc Process" 4th ed (1977) T. H. James, ed.; MacMillen Publishing Co., pp. 363-366.

*Primary Examiner*—Richard L. Schilling
*Assistant Examiner*—Mark F. Huff
*Attorney, Agent, or Firm*—Lowe, Price, LeBlanc & Becker

[57] ABSTRACT

A method for retouching a film image comprises applying an aqueous composition to the film image. The aqueous composition comprises from about 5 to about 300 g/l of an acid selected from the group consisting of sulfuric acid, hydrochloric acid, phosphoric acid, and mixtures thereof, from about 1 to about 100 g/l of at least one compound selected from the group consisting of ascorbic acid, oxalic acid, sulfite compounds, hydroxyl amine salts, iodide compounds, hypophosphite compounds, dithionite compounds, tin(II) compounds, and mixtures thereof, and a balance of water.

13 Claims, No Drawings

METHODS AND COMPOSITIONS FOR RETOUCHING FILM IMAGES

FIELD OF THE INVENTION

The present invention relates to methods and compositions for retouching film images, for example of the color negative and reversal types. More particularly, the present invention relates to methods and compositions for retouching film images by the use of aqueous acidic solutions.

BACKGROUND OF THE INVENTION

Retouching is a term commonly applied to a post processing step in photographic film development wherein a film image, for example a color negative film image or a reversal type film image, is treated to proportionally remove and/or reduce the intensity of the dyes therein. In the development of photographic images, a color film transparency is frequently prepared. The film transparency permits some alteration in color or tone, i.e., retouching. Additionally, dye transfers which are continuous tone prints printed in magenta, cyan and yellow can be used for retouching when more work is required than can be done on a transparency or when the transparency is not sufficiently large to permit sufficient working thereon. In the retouching process, it may be necessary to remove entirely, or at least to reduce the intensity of, one or more of the three colors. Various chemical substances are available which act as solvents for one or more of the dyes. Various chemical compositions and combinations are also available which attempt to remove or reduce the intensity of all three dyes. Generally, retouching involving the chemical process of reducing the cyan, magenta and yellowed dye sets in an overall neutral manner to their leuco or uncolored form is often desirable.

Patent defensive publication No. T 883,013 discloses the use of a mixture of a 5-pyrazolone coupler and a naphthol sulfonic acid to uncouple cyan dye and form a soluble dye which can be washed out of the film. Defensive publication T 896,053 discloses, for the same purpose, the use of an iodine and potassium iodide solution, followed by treatment with ammonium thiosulfate. The Anderson U.S. Pat. No. 4,370,402 discloses aqueous compositions for removing or reducing the intensity of dyes in dye transfers. The composition comprises a thiourea and an ammonium nitrate compound.

Many prior art retouching compositions are directed to reducing the intensity of only one or two dye colors, or provide only limited success in the overall bleaching or retouching of filmed images. Accordingly, there is a continuing need for improved retouching compositions and methods for use in the photographic art.

SUMMARY OF THE INVENTION

Accordingly, it is an object of the present invention to provide methods and compositions for retouching film images, for example of the color negative and reversal types. It is a further object of the present invention to provide methods and compositions for retouching film images, wherein overall bleaching or retouching of the cyan, magenta and yellow dyes may be achieved. It is a further object of the present invention to provide methods and compositions for retouching film images, wherein the dyes may be reduced in their color intensity or reduced to their leuco colorless forms These and additional objects are provided by the methods and compositions of the present invention. In accordance with the invention, the present methods for retouching a film image comprise applying an aqueous retouching composition to the film image. The aqueous composition comprises from about 5 to about 300 g/l of an acid selected from the group consisting of sulfuric acid, hydrochloric acid, phosphoric acid and mixtures thereof, from about 1 to about 100 g/l of at least one compound selected from the group consisting of ascorbic acid, oxalic acid, sulfide compounds, hydroxyl amine salts, iodide compounds, hypophosphite compounds, dithionite compounds, tin(II) compounds, and mixtures thereof, and a balance of water.

The present inventors have discovered that application of these compositions allows advantageous retouching of film images. The present methods and compositions are also advantageous in that retouching may be accomplished in a single step to provide an overall neutral density shift.

These and additional objects and advantages will be more fully apparent in view of the following detailed description.

DETAILED DESCRIPTION OF THE PREFERRED EMBODIMENTS

In the methods of the present invention, an aqueous composition is applied to a film image in order to effect retouching of the film image. The film image may be contained on any medium conventional in the photographic art including, for example, color negative film images and reversal type film type images. As is conventional in the art, the aqueous compositions may be applied by a swab or alternatively, by immersing the substrate bearing the film image in the aqueous composition After application of the aqueous composition for a time sufficient to achieve the desired retouching effects, the film image may be rinsed, for example swabbed, with water to remove remaining chemicals.

The aqueous compositions employed in the present methods comprise from about 5 to about 300 g/l of an acid selected from the group consisting of sulfuric acid, hydrochloric acid, phosphoric acid and mixtures thereof. In a preferred embodiment, this acid is included in an amount of from about 100 to about 300 g/l. In a further preferred embodiment, the acid comprises sulfuric acid.

The aqueous compositions also include from about 1 to about 100 g/l of at least one compound selected from the group consisting of ascorbic acid, oxalic acid, sulfide compounds, hydroxyl amine salts, iodide compounds, hypophosphite compounds, dithionite compounds, tin(II) compounds and mixtures thereof. Preferably, the aqueous compositions comprise from about 10 to about 80 g/l of at least one of these compounds. The sulfide, iodide, hypophosphite and dithionite compounds suitable for use in the compositions of the present invention are those which produce sulfide, iodide, hypophosphite and dithionite ions, respectively. Preferred ion-producing compounds of this type include sodium sulfide, potassium iodide, sodium iodide, ammonium iodide, sodium hypophosphite, sodium dithionite, and the like. A hydroxyl amine which is particulary suitable for use in the present compositions comprises hydroxyl amine sulfate. A tin(II) compound particularly suitable for use in the compositions comprises stannous chloride. In a particularly preferred embodiment, the aqueous compositions comprise from about 1 to about 100 g/l of a mixture of a hydroxyl amine salt such as hydroxyl amine sulfate and at least one iodide compound such as potassium iodide, sodium iodide, ammonium iodide, or mixtures thereof.

In a preferred embodiment, the methods according to the present invention employ a composition comprising from about 100 to about 300 g/l of sulfuric acid, from about 10 to about 80 g/l of a mixture of hydroxyl amine sulfate and at least one compound selected from the group consisting of potassium, iodide, sodium iodide and ammonium iodide and a balance of water. It has been discovered that such compositions advantageously result in overall bleaching of film images. For example, in one embodiment, a preferred aqueous composition comprises 20 g hydroxyl amine sulfate, 2 g potassium iodide, 150 ml sulfuric acid and a balance of water sufficient to result in 1 liter of solution. Ascorbic acid, and/or oxalic acid could be substituted for the hydroxyl amine sulfate while sodium iodide and/or ammonium iodide could be substituted for the potassium iodide.

Use of the present methods and compositions enable retouching to be effected quickly and conveniently without adversely effecting the photographic quality of the transparency, print or dyed transfer bearing the film image.

The photographic elements used in this invention can be single color elements or multicolor elements. Multicolor elements typically contain dye image-forming units sensitive to each of the three primary regions of the visible spectrum Each unit can be comprised of a single emulsion layer or of multiple emulsion layers sensitive to a given region of the spectrum. The layers of the element, including the layers of the image-forming units, can be arranged in various orders as known in the art. In alternative format, the emulsions sensitive to each of the three primary regions of the spectrum can be disposed as a single segmented layer, e.g., as by the use of microvessels as described in the Whitmore U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Amsworth, Hampshire PO10 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the steps of bleaching, fixing, or bleach-fixing, to remove silver and silver halide, washing and drying.

The methods and compositions of the present invention are demonstrated in the following example.

EXAMPLE

In this example, various solutions of retouching compositions were prepared and evaluated on a Ektachrome® duplicating film TYPE 6021. Specifically, screening tests were run by preparing aqueous solutions of the compositions set forth in Table I and applying the solutions to patched areas of processed duplicating films for one minute. At the end of one minute, the films were rinsed by swabbing with water to remove all remaining chemicals. Densitometer readings were made to determine overall neutral dye losses with respect to the various solutions. The retouched films were also evaluated by visual assessment of edge effects occurring between image fields which had been treated and those which had not been treated. The duplicating film which was employed had an overall gray exposure with Status A reading of 1.66/1.73/1.70 for the cyan/magenta/yellow dyes. The corresponding change in the cyan/magenta/yellow records for the one minute application time are also set forth in Table I. In Table I, KI represents potassium iodide, HAS represents hydroxyl amine sulfate, OA represents oxalic acid and AA represents ascorbic acid.

TABLE I

| Sample | Additive | $H_2SO^4$(ml) | $H_2O$(ml) | Change in Density C | M | Y |
|---|---|---|---|---|---|---|
| 1 | None | 0.75 | 4.25 | −4 | −7 | −9 |
| 2 | None | 1.50 | 4.25 | −9 | −45 | −31 |
| 3 | 0.5 gKI | 1.50 | 4.25 | −20 | −9 | −31 |
| 4 | 0.1 gHAS | 0.75 | 4.25 | −4 | −7 | −8 |
| 5 | 0.1 gOA | 0.75 | 4.25 | −4 | −11 | −12 |
| 6 | 0.1 g.AA | 0.75 | 4.25 | −5 | −9 | −11 |
| 7 | 0.1 gAA/ 0.1 g KI | 0.75 | 4.25 | −51 | −76 | −22 |
| 8 | 0.1 gHAS/ 0.1 g KI | 0.75 | 4.25 | −30 | −10 | −14 |
| 9 | 0.1 gOA/ 0.1 g KI | 0.75 | 4.25 | −33 | −30 | −14 |
| 10 | 0.05 gAA/ 0.05 g KI | 0.75 | 4.25 | −44 | −77 | −24 |
| 11 | 0.05 gAA/ 0.05 g KI | 0.40 | 4.25 | −26 | −40 | −13 |
| 12 | 0.05 gAA/ 0.1 g KI | 0.40 | 4.25 | −44 | −64 | −17 |
| 13 | 0.1 gOA/ 0.1 g KI | 0.75 | 4.25 | −20 | −6 | −9 |
| 14 | 0.05 gOA/ 0.05 g KI | 0.75 | 4.25 | −10 | −5 | −7 |
| 15 | 0.05 gOA/ 0.05 g KI | 1.00 | 4.25 | −18 | −7 | −16 |
| 16 | 0.1 gHAS/ 0.05 g KI | 0.75 | 4.25 | −17 | −8 | −14 |
| 17 | 0.1 gHAS/ 0.1 g KI | 0.75 | 4.25 | −30 | −10 | −14 |
| 18 | 0.1 gHAS/ 0.025 g KI | 0.75 | 4.25 | −14 | −11 | −17 |
| 19 | 0.1 gHAS/ 0.02 g KI | 0.75 | 4.25 | −10 | −10 | −13 |

The results set forth in Table I indicate that various compositions employed therein are advantageous for retouching the film images. Particulary, the composition of Sample 19, employing a combination of hydroxyl amine sulfate, potassium iodide and sulfuric acid, advantageously exhibited an overall neutral density decrease. This sample also desirably exhibited a soft edge between the image fields which had been retouched and those which had not been retouched.

The preceding Example is set forth to illustrate specific embodiments of the invention and is not intended to limit the scope of the methods and compositions of the present invention. Additional embodiments and advantages within the scope of the claimed invention will be apparent to one of ordinary skill in the art.

We claim:

1. A method for retouching a color photographic film image, comprising applying to the film image an aqueous composition comprising from about 5 to about 300 g/l of an acid selected from the group consisting of sulfuric acid, hydrochloric acid, phosphoric acid and mixtures thereof, from about 1 to about 100 g/l of at least one compound selected from the group consisting of ascorbic acid, oxalic acid, sulphide compounds, hydroxyl amines, iodide compounds, hypophosphite compounds, dithionite compounds, tin(II) compounds, and mixtures thereof, and a balance of water, whereby dyes in the color photographic film image are reduced in their color intensity or reduced to their leuco colorless forms.

2. A method for retouching a film image as defined by claim 1, wherein the aqueous composition comprises sulfuric acid.

3. A method for retouching a film image as defined by claim 1, wherein the aqueous composition comprises from about 100 to about 300 g/l of the acid selected from the group consisting of sulfuric acid, hydrochloric acid, phosphoric acid and mixtures thereof.

4. A method for retouching a film image as defined by claim 1, wherein the aqueous composition comprises from about 1 to about 100 g/l of at least one compound selected from the group consisting of ascorbic acid, oxalic acid, sodium sulphide, hydroxyl amine sulfate, potassium iodide, sodium iodide, ammonium iodide, sodium hypophosphite, sodium dithionite compounds, stannous chloride, and mixtures thereof.

5. A method for retouching a film image as defined by claim 4, wherein the aqueous composition comprises from about 1 to about 100 g/l of a mixture of hydroxyl amine sulfate and at least one compound selected from the group consisting of potassium iodide, sodium iodide and ammonium iodide.

6. A method for retouching a film image as defined by claim 1, wherein the aqueous composition comprises from about 10 to about 80 g/l of at least one compound selected from the group consisting of ascorbic acid, oxalic acid, sulphide compounds, hydroxyl amines, iodide compounds, hypophosphite compounds, dithionite compounds, tin(II) compounds, and mixtures thereof.

7. A method for retouching a film image as defined by claim 1, wherein the aqueous composition comprises from about 100 to about 300 g/l of sulfuric acid, from about 10 to about 80 g/l of a mixture of hydroxyl amine sulfate and at least one compound selected from the group consisting of potassium iodide, sodium iodide and ammonium iodide, and a balance of water.

8. A method for retouching a film image as defined by claim 1, wherein the film image comprises a color negative film image.

9. A method for retouching a film image as defined by claim 1, wherein the film image comprises a reversal type film image.

10. A method for retouching a film image as defined by claim 1, including the further step of rinsing the aqueous composition from the film image.

11. An aqueous composition for retouching a color photographic film image, comprising from about 100 to about 300 g/l of an acid selected from the group consisting of sulfuric acid, hydrochloric acid, phosphoric acid and mixtures thereof, from about 1 to about 100 g/l of a mixture of hydroxyl amine sulfate and at least one compound selected from the group consisting of potassium iodide, sodium iodide and ammonium iodide, and a balance of water.

12. An aqueous composition as defined by claim 11, comprising sulfuric acid.

13. An aqueous composition as defined by claim 11, comprising from about 100 to about 300 g/l of sulfuric acid, from about 10 to about 80 g/l of a mixture of hydroxyl amine sulfate and at least one compound selected from the group consisting of potassium iodide, sodium iodide and ammonium iodide, and a balance of water.

* * * * *